US009506415B2

(12) United States Patent
Mullen

(10) Patent No.: US 9,506,415 B2
(45) Date of Patent: Nov. 29, 2016

(54) CONTROLLER FOR MODIFYING THE VOLTAGE SIGNAL OF AN EXHAUST GAS OXYGEN SENSOR

(71) Applicant: Stephen Mullen, Oldsmar, FL (US)

(72) Inventor: Stephen Mullen, Oldsmar, FL (US)

( * ) Notice: Subject to any disclaimer, the term of this patent is extended or adjusted under 35 U.S.C. 154(b) by 63 days.

(21) Appl. No.: 14/586,310

(22) Filed: Dec. 30, 2014

(65) Prior Publication Data

US 2015/0198108 A1 Jul. 16, 2015

Related U.S. Application Data

(60) Provisional application No. 61/922,153, filed on Dec. 31, 2013.

(51) Int. Cl.
*F02D 41/14* (2006.01)
*F02D 41/28* (2006.01)

(52) U.S. Cl.
CPC ..... *F02D 41/1487* (2013.01); *F02D 41/1454* (2013.01); *F02D 41/1475* (2013.01); *F02D 2041/281* (2013.01); *F02D 2041/286* (2013.01); *F02D 2400/11* (2013.01)

(58) Field of Classification Search
CPC ..... F02D 41/14; F02D 41/1439; F02D 41/1454; F02D 41/1487; F02D 41/30; F02D 41/3005; F01M 15/104
USPC ..... 701/102–104, 109; 123/672, 693–696, 123/703
See application file for complete search history.

(56) References Cited

U.S. PATENT DOCUMENTS

| | | | | |
|---|---|---|---|---|
| 6,260,547 | B1 * | 7/2001 | Spencer-Smith | F02D 41/1476 123/687 |
| 2003/0004634 | A1 * | 1/2003 | Meyer | B01D 53/9495 701/108 |
| 2007/0005223 | A1 * | 1/2007 | Feucht | G01M 15/06 701/114 |
| 2009/0138182 | A1 * | 5/2009 | Bruhn | F02D 41/1476 701/109 |
| 2009/0192694 | A1 * | 7/2009 | Mullen | F02D 41/1454 701/103 |

* cited by examiner

*Primary Examiner* — John Kwon
*Assistant Examiner* — Johnny H Hoang
(74) *Attorney, Agent, or Firm* — Stephen Lewellyn; Maxey Law Offices, PLLC

(57) ABSTRACT

A control device is interposable between an oxygen sensor and an electric control unit of a motor vehicle to receive a voltage signal of the oxygen sensor, alter the voltage signal, and output an altered voltage signal. The altered voltage signal is received by the electronic control unit and causes the electronic control unit to produce fuel injector control signals that provide a richer fuel mixture to the internal combustion engine than what would be provided in the absence of said controller.

5 Claims, 5 Drawing Sheets

CONTROLLER FOR MODIFYING THE VOLTAGE SIGNAL OF AN EXHAUST GAS OXYGEN SENSOR

CROSS-REFERENCE TO RELATED APPLICATION

This application claims the benefit of U.S. provisional patent application No. 61/922,153, filed Dec. 31, 2013, the entirety of which is incorporated herein by reference.

FIELD OF THE INVENTION

The present invention relates generally to the closed-loop air/fuel control of an internal combustion engine, and more particularly, to the modification of the closed-loop air/fuel control without modifying the programming of an electronic control unit used to control the internal combustion engine.

BACKGROUND OF THE INVENTION

Most modern internal combustion engines utilize a form of electronic fuel-injection (EFI) system to control the air/fuel ratio (AFR) of the combustion mixture. The EFI system works to control the air/fuel ratio under all operating conditions to achieve the desired engine performance, emissions, driveability, and fuel economy. EFI systems use a programmed electronic control unit (ECU) or module (ECM) to monitor engine operating conditions and control fuel injection to increase or decrease the air/fuel ratio depending on the engine operating conditions. The ECU operates either in an open-loop controlled fuel injection with predetermined fuel maps, or in a closed-loop feedback-controlled fuel injection. Closed-loop feedback-controlled fuel injection varies the fuel injector output according to real-time sensor data rather than operating with the predetermined (open-loop) fuel map.

Real-time sensor data from an oxygen sensor (or "O2 sensor") is used to measure the proportion of oxygen (O2) in the exhaust gas. The oxygen sensor generates an electrical voltage indicating the amount of oxygen measured in the exhaust gas. The oxygen sensor generates a voltage in the range of about 0 to 1 volts. Higher voltages (greater than 0.5 volts) means there is less oxygen in the exhaust and indicates a rich mixture. Lower voltages (less than 0.5 volts) means there is more oxygen in the exhaust and indicates a lean mixture. The ECU reads the oxygen sensor voltage signal and produces fuel injector control signals to operate the fuel injectors to either richen the fuel mixture or to lean the fuel mixture.

For gasoline fuel burning engines, manufactures typically preprogram the ECU to control the fuel injectors to maintain a stoichiometric AFR of 14.7:1 for the majority of engine operating conditions. Any mixture less than 14.7:1 is considered to be a rich mixture, any more than 14.7:1 is a lean mixture. Most oxygen sensors are manufactured to generate a voltage of 0.5 volts when the AFR is 14.7:1.

It is known to modify an existing ECU to adjust the performance of the internal combustion engine. Heretofore, modifying an existing ECU has required reprogramming the programmable eprom or computer chip, replacing the eprom with another eprom having a different program, or piggy backing the ECU with another controller that operates to intercept signals, modify the intercepted signals and then pass the modified signal to various engine operating components to achieve the desired engine performance.

Various problems can arise when an existing ECU is modified as indicated above. The physically changed or new eprom must be to manufacture's application, and during use may cause knocking, drivability issues both at idle and wide open throttle, lean misfires, detonation, signaling of trouble codes in vehicles equipped with on-board diagnostic (OBD), void manufacture's warranties, and require physical modification of the engine's electrical wiring harness.

Accordingly, there is a need for an apparatus and method that can be employed to modify the performance of internal combustion, and specifically, the air/fuel ratio of an internal combustion engine that overcomes the drawbacks of the prior art.

SUMMARY OF THE INVENTION

The embodiments of the present invention addresses this need by providing a passive control device that is interposable between an exhaust gas sensor, such as an oxygen sensor, and the electronic control unit (ECU) to modify the air/fuel ratio without reprogramming the ECU.

In general, in one aspect, an apparatus for modifying the performance of an internal combustion engine of a motor vehicle including fuel injectors, an oxygen sensor for sensing the amount of oxygen in the exhaust gas produced by the internal combustion engine, and a preprogrammed electronic control unit for receiving a voltage signal from the oxygen sensor, and in response thereto producing fuel injector control signals controlling the operation of the fuel injectors, is provided. The apparatus includes a controller that is connected to the oxygen sensor by electrical connection and to the electronic control unit by electrical connection such that the controller is connected between the oxygen sensor and the preprogrammed electronic control unit. The controller operates to receive the voltage signal of the oxygen sensor, alter the voltage signal, and output an altered voltage signal that is received by the electronic control unit. The altered voltage signal cause the electronic control unit to produce fuel injector control signals that provide a richer fuel mixture to the internal combustion engine than what would be provided in the absence of the controller.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Embodiments of the present invention provide an apparatus and method for adjusting the fuel mixture of an internal combustion engine during closed-loop control and without altering the look-up tables or fuel maps of the engine's electronic control unit (ECU). The fuel mixture is adjusted by altering the voltage signal of an exhaust gas oxygen sensor before the ECU receives the voltage signal and then receiving the altered voltage signal by the ECU. The altered voltage signal is then used by the ECU in connection with the ECU's fuel maps to control the engine's fuel injectors, which results in a different fuel mixture that would have been produced using the unaltered voltage signal.

Figure 1:
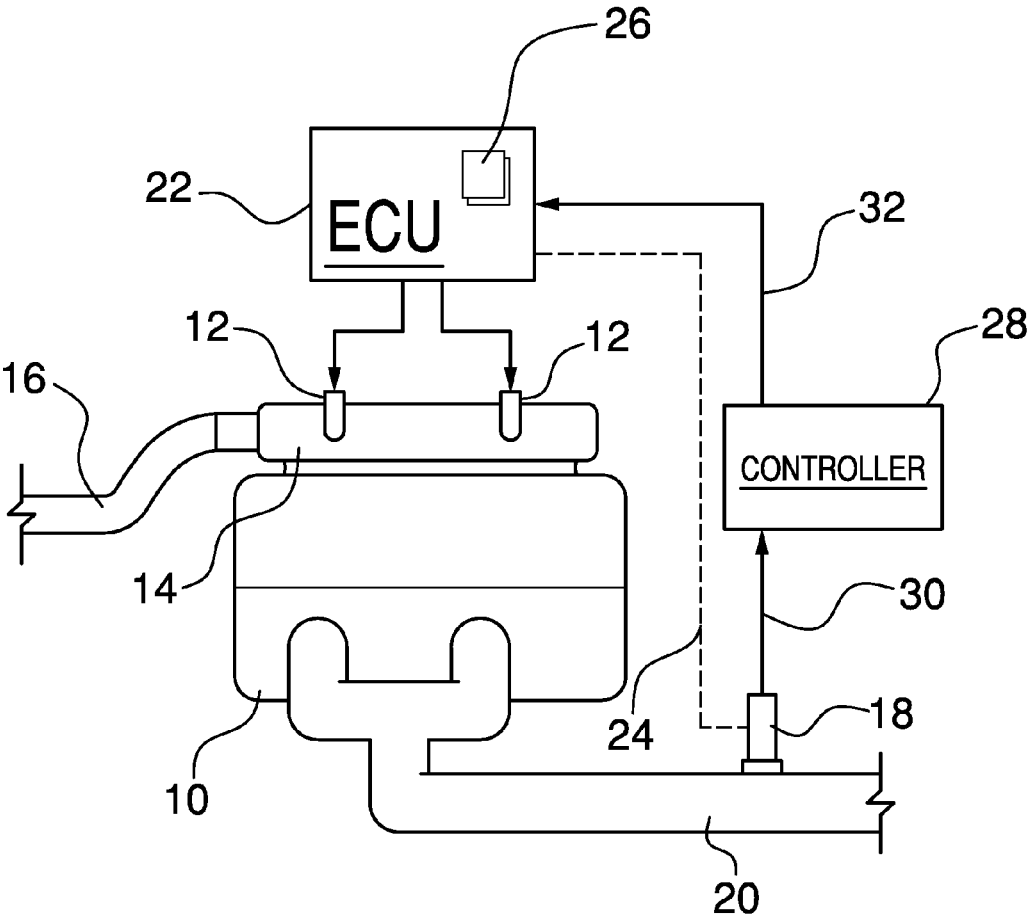
FIG. 1 is a schematic view of an internal combustion engine and a controller for modifying the voltage signal of an exhaust gas oxygen sensor that is constructed in accordance with the principles of the present invention.

Now referring initially to FIG. 1, there is diagrammatically illustrated, in a simplified form, a conventional internal combustion engine 10 having fuel injectors 12 arranged in an air intake manifold 14 that is disposed along an air intake passage 16. The engine 10 further includes a conventional exhaust gas sensor (O2 sensor) 18 operatively connected to an exhaust gas pipe 20. The O2 sensor 18 operates to sense the oxygen content of an exhaust gas flowing through the exhaust pipe 20 and to output a voltage signal related to sensed oxygen content.

The engine 10 further includes an electronic control unit (ECU) 22 that is connected to the fuel injectors 12 and conventionally connected to the O2 sensor 18, shown by broken line 24, such that the ECU receives the voltage signal. The ECU 22 uses the voltage signal in connection with pre-programmed fuel maps 26 to control the fuel injectors 12 to create a desired fuel mixture. In practice the ECU 22 would be connected to various other engine sensors that are also used by the ECU to control the fuel injectors. These sensors are not shown because the engine is illustrated in a simplified form. And a discussion of the eliminated sensors is not required to understand the embodiments of the present invention.

With continued reference to FIG. 1, embodiments of the present invention provides a controller 28, such as a programmable logic controller, that is connected to the O2 sensor 18 by electrical connection 30 and to the ECU 22 by electrical connection 32 such that the controller is connected between the O2 sensor and ECU. The controller 28 operates to receive the voltage signal of the O2 sensor 18, alter the voltage signal, and output an altered voltage signal that is received by the ECU 22. The ECU 22, not aware that it has received an altered voltage signal, uses the altered voltage signal in connection with the fuel maps 26 to control the fuel injectors 12 to produce a fuel mixture that is different from a fuel mixture that would have been produced if the unaltered voltage signal was received by the ECU. The controller 28 can operate to alter the voltage signal such that the altered voltage signal results in a richer or a leaner fuel mixture compared to the fuel mixture that would have been produced if the unaltered voltage signal was used.

Additionally, while not illustrated, the controller 28 may also operate to filter the voltage signal received by the O2 sensor before altering and may also operate to filter the altered voltage signal before outputting the altered voltage signal to the ECU. The controller 28 may utilize one or more signals of various engine sensors in its filtering operations of the voltage signals. Such engine sensors may include, but are not limited to, a throttle position sensor (TPS), an engine RPM sensor, and an engine manifold pressure (MAP), among other sensors.

Figure 2:
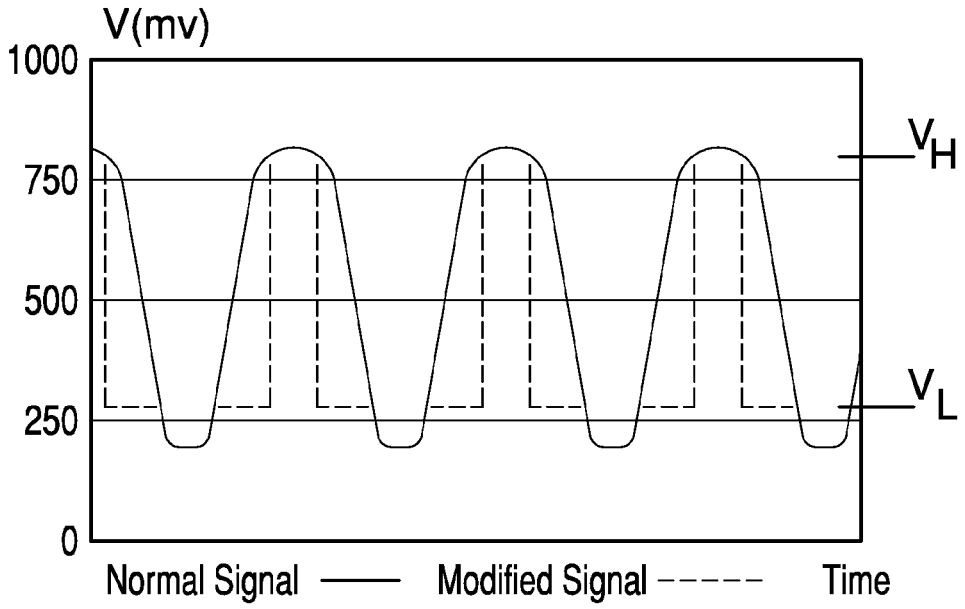
FIG. 2 representatively shows an exemplary unaltered oxygen sensor voltage wave form and a respective altered voltage wave form that is superimposed on the unaltered wave form.
Figure 3:
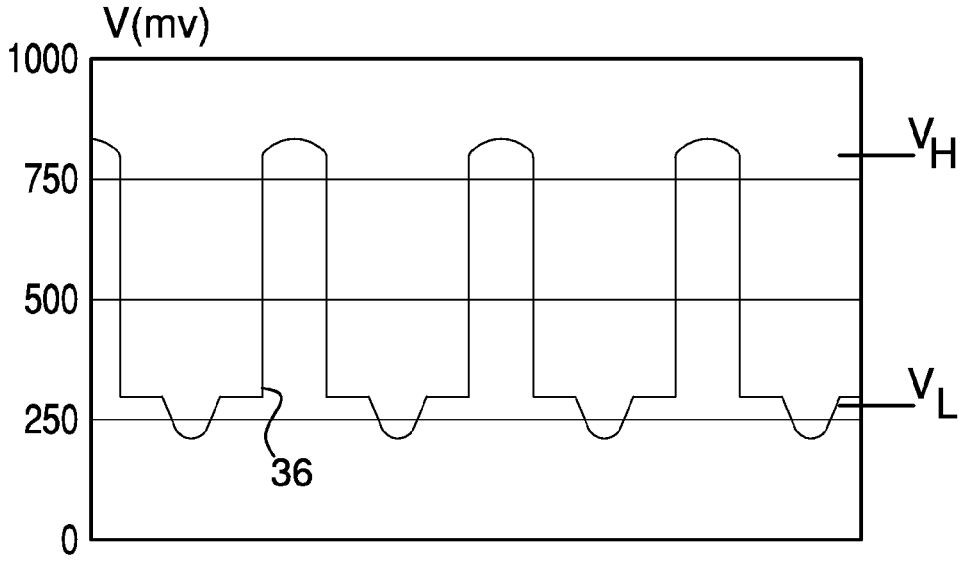
FIG. 3 depicts the altered voltage wave form of FIG. 2.

In FIG. 2, there is illustrated, in the time-domain, an exemplary unaltered voltage signal 34 (shown in solid line) and an exemplary altered voltage signal 36 (shown in broken line) that is superimposed over the unaltered voltage signal. The exemplary altered voltage signal 36 is show separately in FIG. 3 to clearly illustrate the altered voltage signal that is received by the ECU. As can be seen from these exemplary signal wave forms, the controller 28 operates to chop the voltage signal between a low threshold voltage $V_L$ and a high threshold voltage $V_H$ resulting in a somewhat square wave form that retains the amplitudes of the original voltage signal. The values of $V_L$ and $V_H$ can be adjusted as desired to create an altered voltage signal that results in a desired modified air fuel mixture.

Figure 4:
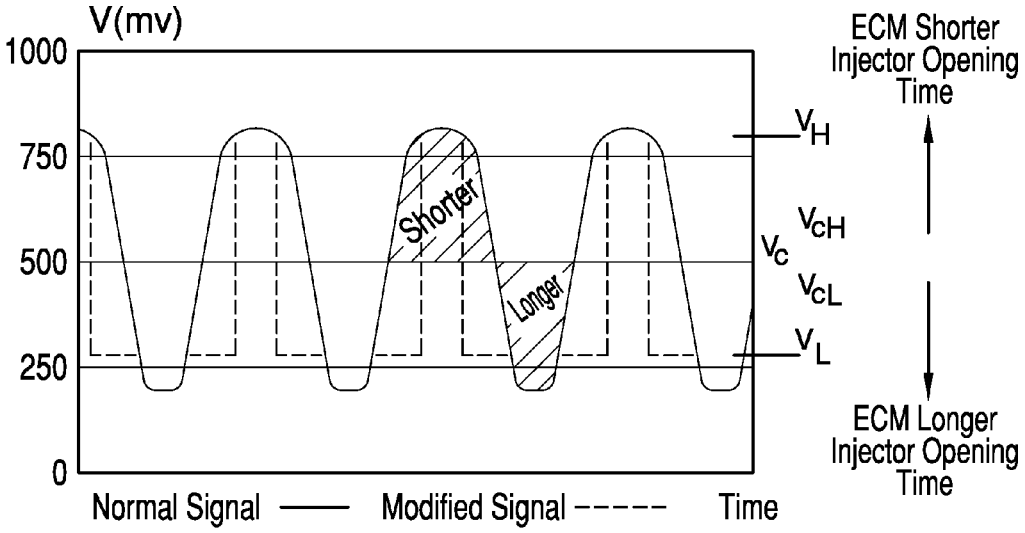
FIG. 4 depicts exemplary unaltered oxygen sensor voltage wave form and illustrates injector control by the ECU.

In FIG. 4, the illustrated exemplary diagram of the normal signal also describes the actions of the ECU in reaction to changing air fuel mixtures. As the voltage rises, the ECU will shorten injector opening time to lean the air fuel mixture. As the voltage lowers, the ECU will lengthen injector opening time to richen the air fuel mixture. In an idealized ECU these transitions are assumed to occur around the Centering Voltage (Vc) or 500 mV for a typical narrow band lambda sensor. The standard relationship between longer and shorter injector opening times ultimately defines the air fuel ratio over a period of time for the ECU.

The typical switch point of the ECU operates around a VC+/−125 mV (typical) to smooth transitions between a richer and a leaner fuel mixture. This gives an estimated set point of Vh higher than Vch for the device to be effective with a corresponding Vl set point lower than Vcl. The Vc and high/low centering voltage point (Vch/Vcl) are specific to the ECU and manufacture programming.

Figure 5:
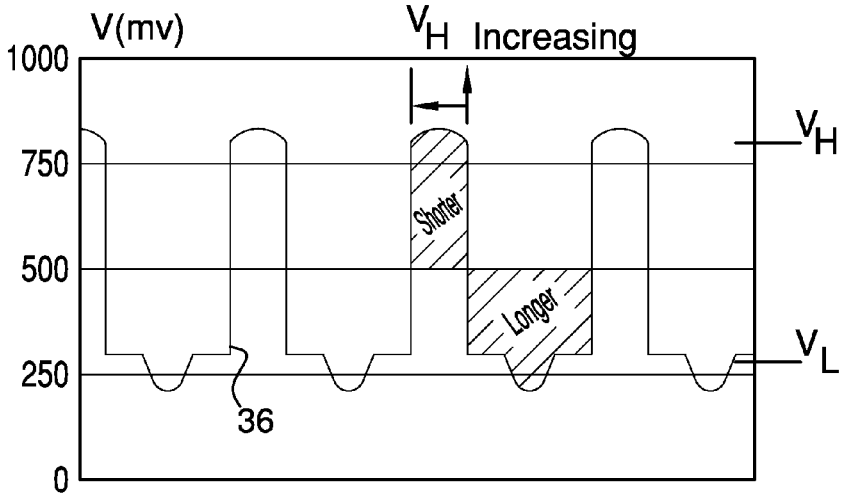
FIG. 5 depicts the change in relationship between lengthened injector open time and shortened injector open time.

In FIG. 5, the illustrated exemplary diagram shows the change in the relationship between injector opening times as the Vh and/or Vl is changed. As Vh and Vl are changed, the difference in the area of the graph represented above or below the Vc for a complete cycle would represent the overall change in the air fuel mixture with the invention.

FIGS. 4 and 5 represent operation in a typical ECU environment with a narrow band O2 sensor, but the invention is not limited to use with narrow band O2 sensors and air fuel mixture control.

Figure 6:
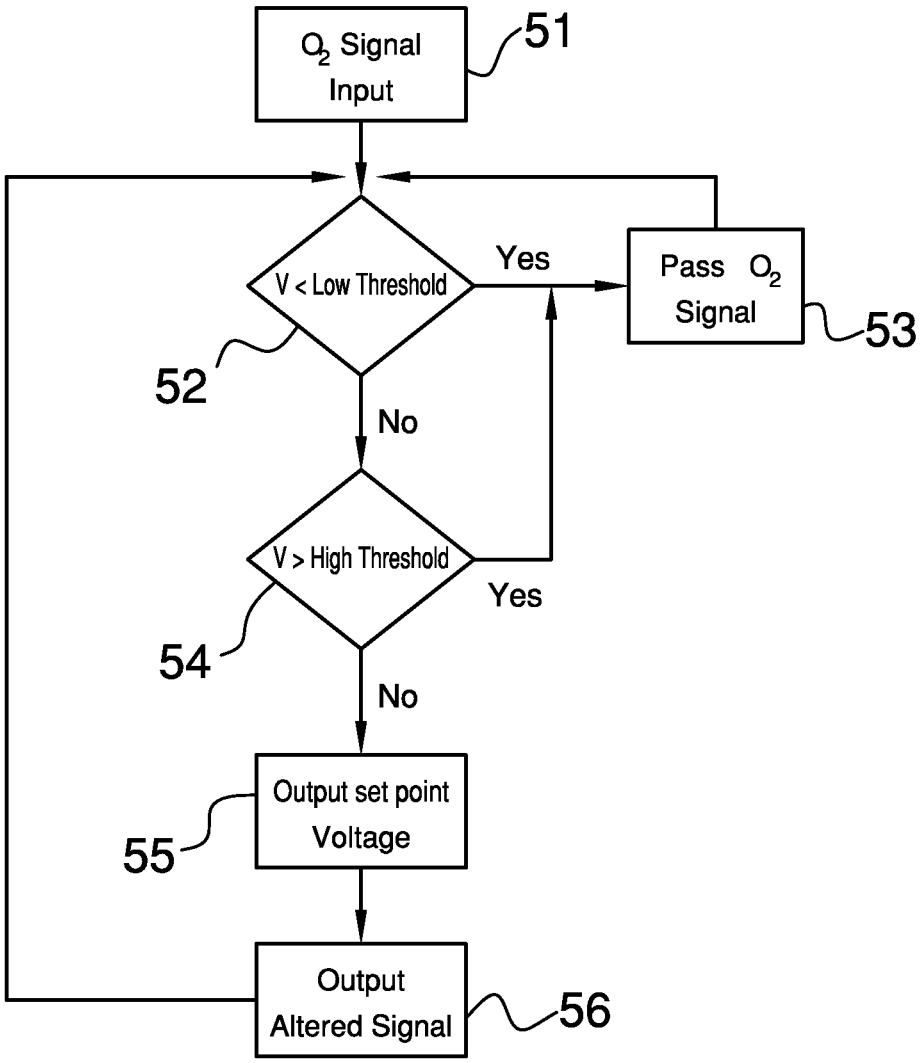
FIG. 6 is a process diagram of a process implemented by the controller to alter the voltage signal and produce the altered voltage wave form.

In FIG. 6, there is illustrated an exemplary block diagram of an operation performed by the controller 28 to alter the voltage signal and output the altered voltage signal. For example, at step S1 the original or unaltered voltage signal of the O2 sensor is received by the controller 28 and the process moves to step S2. At step S2, the voltage signal is compared to $V_L$, and if the voltage is less than $V_L$ the original voltage signal is passed through to the ECU at step S3 and process returns to step S2. Determining whether the original voltage signal is below $V_L$, at step S2, operates to retain the lower amplitude of the original voltage signal. If the original voltage signal is not less than $V_L$, then the process moves to step S4.

At step S4, the controller operates to compare the original voltage signal to $V_H$, and if the voltage is greater than $V_H$ the original voltage signal is passed through to the ECU at Step S3 and the process returns to step S2. Determining whether the original voltage signal is greater than $V_H$, at step S4, operates to retain the higher amplitude of the original voltage signal. If the original voltage signal is less than $V_H$, then the process moves to step S5.

At step S5, the original voltage signal is chopped by setting the voltage to an output voltage that is selected to equal either $V_H$ or $V_L$ depending whether the wave form is rising or falling. If the wave form is rising, the voltage output is selected to be $V_H$ and if the wave form is falling, the voltage output is selected to be $V_L$. To determine if the wave form is rising or falling, at step S5, the voltage at S2 is compared with the voltage at S3, and if the voltage at S3 is higher than the voltage at S2, it is determined that the wave form is rising and the output voltage is set to $V_H$. If the wave form is not rising, it is determined that the wave form is falling and the output voltage is set to $V_L$. Once the voltage output is set to either $V_H$ or $V_L$, the process moves to step S6. At step S6, the altered voltage signal is output to be received by the ECU and then the process loops back to S2.

Figure 7:
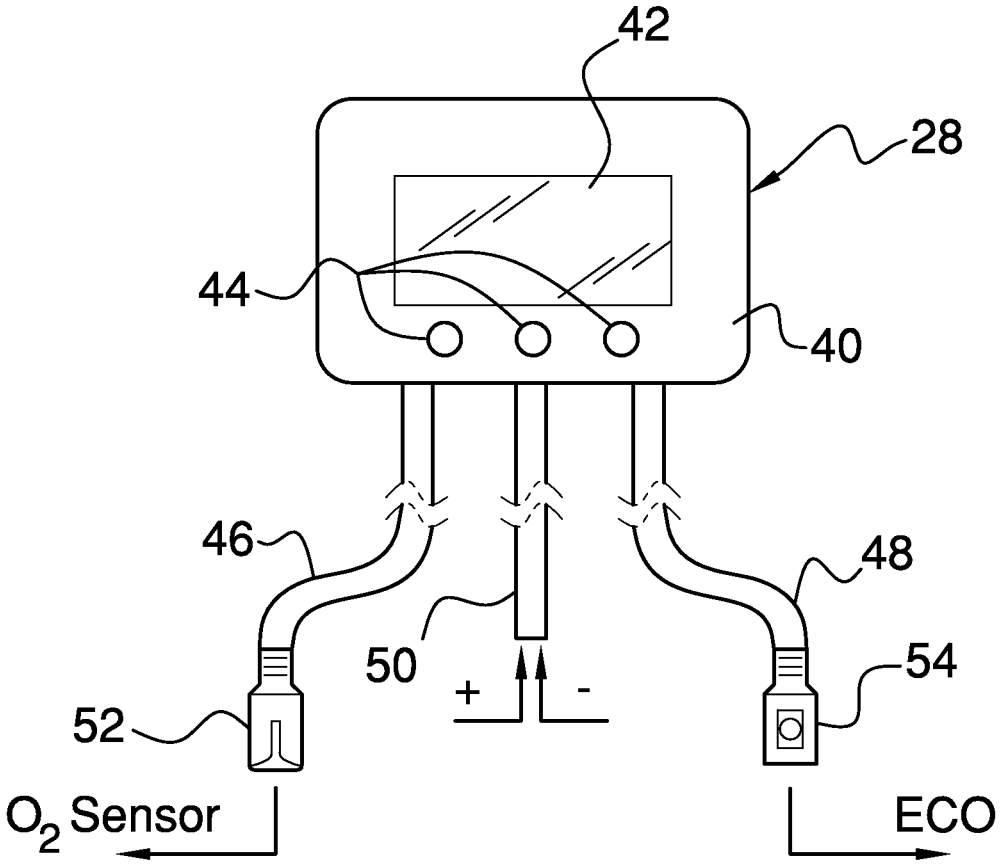
FIG. 7 is a diagrammatic view of a controller constructed in accordance with the principles of the present invention.

In FIG. 7, the controller 28 is representatively illustrated and may include housing 40, a display screen 42 supported by the housing, one or more user interface buttons 44, electrical wiring pigtail 46 for connecting the controller to the O2 sensor, electrical wiring pigtail 48 for connecting the controller to the ECU 22, and electrical wiring 50 for connecting the controller to a source of electrical power.

The display screen 42 is operatively connected to the controller to display various operational messages, graphical user interface, etc. The interface buttons 44 are operatively connected to the controller to permit a user to control, select, or adjust various operations of the controller and to navigate the graphical user interface. Pigtail 46 may include electrical connector 52 that is configured to connect to the conventional electrical connection of the O2 sensor. And, likewise, pigtail may include electrical connector 54 that is configured to connect to the conventional electrical connection of the ECU wiring harness that connects to the O2 sensor, thereby permitting a user to disconnect the ECU wiring harness from the O2 sensor and connect the controller to the O2 sensor via pigtail 46 and connect the ECU wiring harness to the controller via pigtail 48.

A number of embodiments of the present invention have been described. Nevertheless, it will be understood that various modifications may be made without departing from the spirit and scope of the invention.

What is claimed is:

1. A method of modifying the performance of an internal combustion engine of a motor vehicle including fuel injectors, an oxygen sensor for measuring the amount of oxygen in the exhaust gas produced by the internal combustion engine, and a preprogrammed electronic control unit for receiving a voltage signal from the oxygen sensor, and in response thereto producing fuel injector control signals controlling the operation of the fuel injectors, the method comprising the steps of:

interposing a controller between the oxygen sensor and the preprogrammed electronic control unit so as to direct the voltage signal of the oxygen sensor to the controller and not to the preprogrammed electronic control unit;

receiving the voltage signal of the oxygen sensor by said controller;

altering said voltage signal by said controller by chopping said voltage signal between a low threshold voltage and a high threshold voltage while retaining the original amplitudes of said voltage signal to produce an altered voltage signal;

outputting said altered voltage signal by said controller;

receiving said altered voltage signal by the preprogrammed electronic control unit; and controlling the fuel injectors by said preprogrammed electronic control unit to produce a modified fuel mixture that is different from a fuel mixture that would have been produced absent said altered voltage signal.

2. The method of claim 1, further comprising the steps of:

determining by said controller whether said voltage signal is higher than said high threshold voltage and whether the voltage signal is lower than said low threshold voltage.

3. The method of claim 1, further comprising the steps of:

determining by said controller whether said voltage signal is rising or falling.

4. The method of claim 1, wherein said step of controlling the fuel injectors said modified fuel mixture is richer than said fuel mixture.

5. The method of claim 1, wherein said step of controlling the fuel injectors said modified fuel mixture is leaner than said fuel mixture.

* * * * *